US007610889B2

(12) United States Patent
Boggess et al.

(10) Patent No.: US 7,610,889 B2
(45) Date of Patent: Nov. 3, 2009

(54) CAMSHAFT ASSEMBLY INCLUDING A TARGET WHEEL

(75) Inventors: Michael S. Boggess, Harrison Township, MI (US); Mark R. Arcori, Rochester Hills, MI (US); David W. Fiddes, Lake Orion, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 272 days.

(21) Appl. No.: 11/421,560

(22) Filed: Jun. 1, 2006

(65) Prior Publication Data

US 2007/0277753 A1 Dec. 6, 2007

(51) Int. Cl.
*F01L 1/34* (2006.01)

(52) U.S. Cl. ..... 123/90.6; 123/90.15; 123/90.16; 123/90.17; 123/90.31

(58) Field of Classification Search ..... 123/90.6
See application file for complete search history.

(56) References Cited

U.S. PATENT DOCUMENTS 5,987,973 A * 11/1999 Fujii et al. ..... 73/114.28
6,125,537 A * 10/2000 Kuehl ..... 29/888.1
6,286,196 B1 * 9/2001 Vogel ..... 29/421.1
6,343,580 B2 * 2/2002 Uchida ..... 123/90.17
6,481,270 B1 * 11/2002 Kobayashi et al. ..... 73/114.26
6,901,895 B2 * 6/2005 Mae et al. ..... 123/90.31

FOREIGN PATENT DOCUMENTS

JP 2003293709 A * 10/2003

* cited by examiner

*Primary Examiner*—Zelalem Eshete
(74) *Attorney, Agent, or Firm*—Ralph E. Smith

(57) ABSTRACT

A camshaft assembly including a target wheel is manufactured using an assembly process in which the camshaft is formed from a hollow tube. After the cam rings and a target wheel ring have been correctly positioned on the hollow tube, the tube is pressurized to expand its diameter, locking the rings into position on the tube. Locating the target wheel along the axis of the camshaft and spaced from the camshaft end allows the sensor to be located along the axis of the camshaft, and precludes the need to increase the overall length of the head to accommodate the target wheel and the sensor. In a dual overhead engine, the target wheels may be mounted on the two camshafts so that they may be read by a dual element sensor that is mounted between the two wheels.

10 Claims, 2 Drawing Sheets

CAMSHAFT ASSEMBLY INCLUDING A TARGET WHEEL

FIELD OF THE INVENTION

The present invention relates generally to a camshaft assembly including a target wheel used in a variable valve timing system for an internal combustion engine.

BACKGROUND OF THE INVENTION

Variable valve timing systems for overhead camshaft engines are known in the art. Such systems include a target wheel to indicate the rotational position of the camshaft, and a phaser assembly to alter the rotational position of the camshaft relative to the crankshaft. In order to function properly, the target wheel should rotate in exact synchronization with the camshaft. Current sensor systems use a target wheel mounted on the front or rear end of the camshaft causing an increase in the effective length of the camshaft, and requiring an increase in the overall length of the head. Since the camshaft phaser is normally mounted on the end of the camshaft and the outer periphery of many phaser housings do not rotate, mounting the target wheel on the phaser housing is not suitable. Some engine designs use a rotating PCV valve that is mounted on the end of the camshaft, precluding the use of the camshaft end for the target wheel. Alternatively, the target wheel may be attached to the timing gears. However, a target wheel that is attached to the timing gears often does not give accurate readings of the position of the camshaft because of the play in the timing gear mechanism.

The rotational position of the target wheel has to be read by a sensor. When the target wheel is mounted on the end of the camshaft, a hole has to be made in the head of the engine, and the sensor is mounted in the hole. Each hole has to be drilled and tapped for reception of the sensor, and sealed after the sensor is mounted therein. For an I-configuration engine with dual overhead cams, two mounting holes are required; for a V-configuration engine, four mounting holes are required.

SUMMARY OF THE INVENTION

A target wheel for an overhead cam engine is mounted along the axis of the camshaft, spaced from the camshaft end. The camshaft itself is manufactured using an assembly process in which the camshaft is formed from a hollow tube onto which cam rings are mounted. After the cam rings have been correctly positioned on the hollow tube, the tube is pressurized to expand its diameter, locking the rings into position on the tube. The target wheel for the assembled camshaft is formed as a ring that may be slid into position along the axis of the tube. When the tube is expanded to lock the cam rings into place, the target ring is also locked into place. Locating the target wheel along the axis of the camshaft and spaced from the camshaft end allows the sensor to be located along the axis of the camshaft, and precludes the need to increase the overall length of the head to accommodate the target wheel and the sensor. In a dual overhead engine, the target wheels may be mounted on the two camshafts so that they may be read by a dual element sensor that is mounted between the two wheels.

BRIEF DESCRIPTION OF THE DRAWINGS

These and other objects, features and advantages of the present invention will be apparent from the following detailed description of the preferred embodiments and best mode, appended claims and accompanying drawings in which:

DETAILED DESCRIPTION OF PREFERRED EMBODIMENTS

Figure 1:
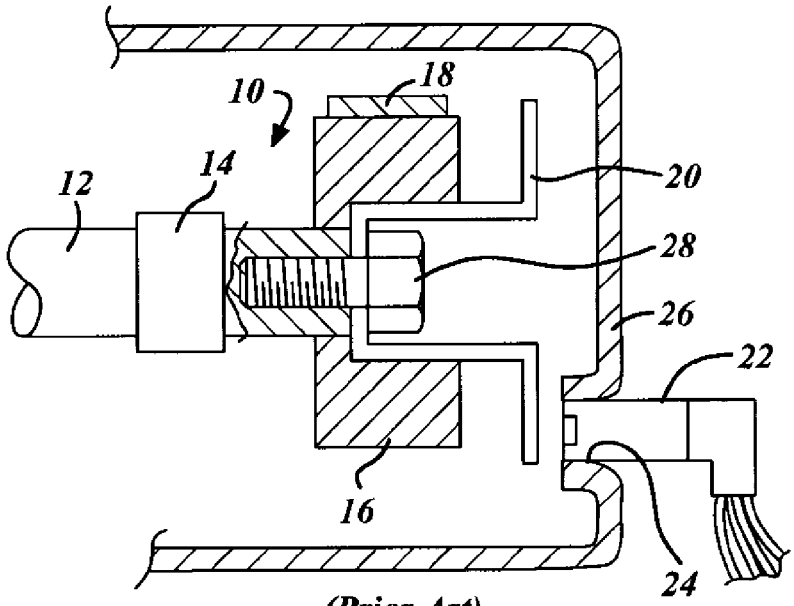
(Prior Art) FIG. 1
FIG. 1 shows the end of a camshaft with a target wheel mounted thereon according to the prior art.

FIG. 1 shows one end of a camshaft 10 used in a variable valve timing engine according to the prior art. The camshaft 10 includes a central shaft 12 with one or more cam lobes 14 formed or mounted thereon. A phaser 16 driven by a chain 18 is mounted on the end of the camshaft 10. A target wheel 20 is mounted on the camshaft and a sensor 22 reads the position of the target wheel. The sensor 22 is mounted in a hole 24 formed in the head 26 of the engine. Since the phaser 16 does not rotate in exact synchronization with the camshaft 10, the target wheel 20 cannot be mounted to the phaser, but has to be fixed to the end of the camshaft by a bolt 28. Because the target wheel 20 extends beyond the end of the end of the camshaft 10 and the phaser 16, the head 26 has to be elongated in order to provide clearance for the target wheel.

Figure 2:
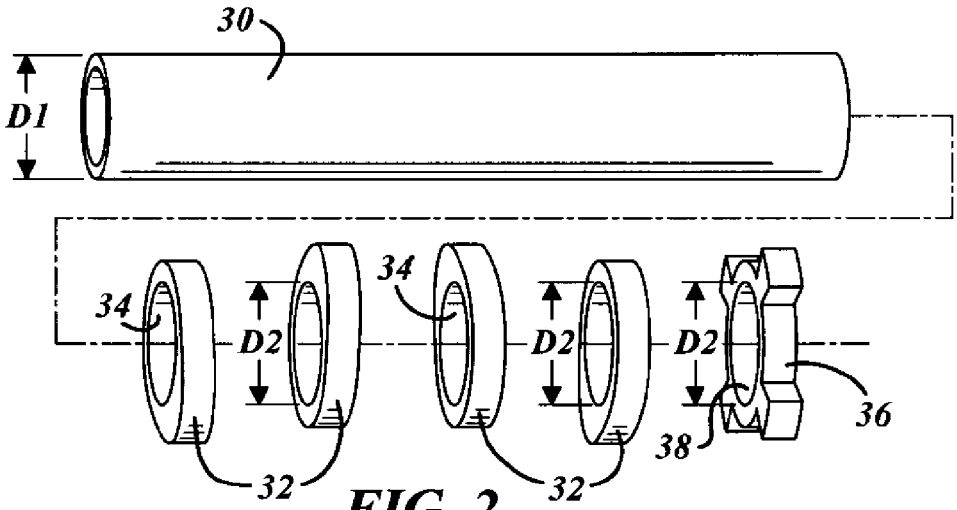
FIG. 2 shows the elements of an assembled camshaft with a target wheel before assembly.

FIG. 2 shows the elements of an assembled camshaft with a target wheel according to one presently preferred implementation of the invention before completion of the assembly process. The camshaft comprises a hollow tube 30 having an outer diameter D1. The hollow tube 30 will receive a plurality of cam rings 32, each of which is formed with an inner bore 34 having a diameter D2 that is slightly larger than D1. The hollow tube will also receive a target wheel ring 36 having an inner bore 38 with a diameter D2. Once the cam rings 32 and the target wheel ring 36 are in the proper position on the hollow tube 30, the interior of the hollow tube is pressurized to expand the outer diameter of the hollow tube from D1 to D2 at least in the region of the cam rings 32 and the target wheel ring 36. This expansion locks the cam rings 32 and the target wheel ring 36 in place on the hollow tube to form an assembled camshaft with a target wheel.

Figure 3:
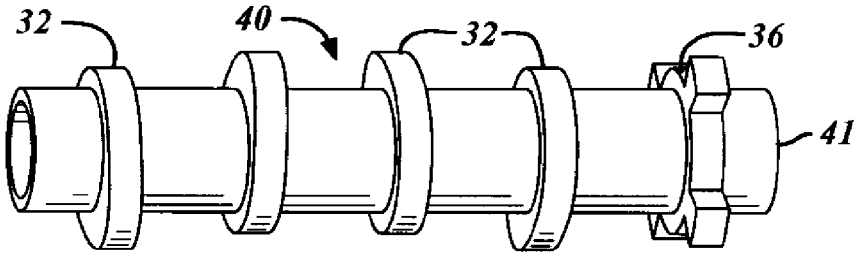
FIG. 3 shows an assembled camshaft with a target wheel after assembly.

FIG. 3 shows an assembled camshaft 40 with a plurality of cam rings 32 and a target wheel 36 after assembly. The target wheel 36 is mounted along the axis of the camshaft 40, and is spaced from the camshaft end 41.

Figure 4:
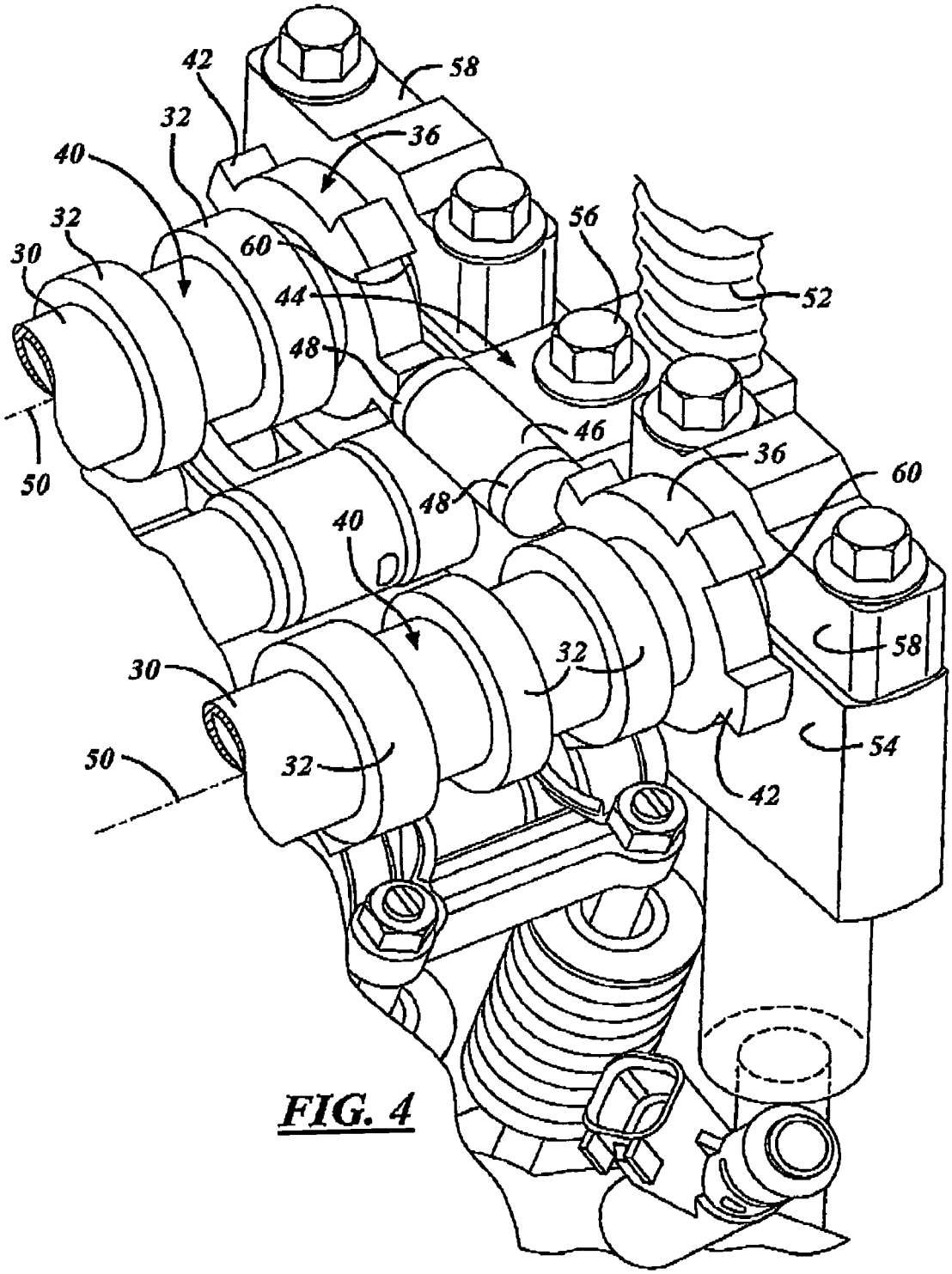
FIG. 4 shows the ends of two assembled camshafts with target wheels mounted in a dual overhead cam engine.

FIG. 4 shows a portion of the head assembly of a dual overhead cam engine including the ends of two assembled camshafts 40. Each assembled camshaft 40 is provided with a target wheel 36, which turns in unison with the camshaft 40. Each target wheel 36 has one or more signal producing features such as a notch or a tooth 42 for producing a pulse in a sensing device as is well known in the art. Each target wheel 36 may be made of ferromagnetic material or molded magnetic material that can be polarized in any pattern.

A sensor assembly 44 is mounted between the two target wheels 36. The sensor assembly 44 includes a common housing 46 and two sensing elements 48, one facing one target wheel 36 and one facing the other target wheel 36. In the embodiment shown, the sensing elements 48 face in opposite directions and are disposed generally directly between the camshafts 40 on the centerline of the camshafts, or along a plane containing the axis of rotation 50 of each camshaft 40. Other arrangements and positions can be utilized. The sensors 48 on the sensor assembly 44 may be Hall Effect sensors or any other suitable sensor-type, as desired. Wires coupling power and signals to and from the sensors 48 in the sensor housing 46 are contained within a shroud or conduit 52 that extends from the sensor assembly 44 to a point external to the engine.

The sensor assembly 44 is mounted on the pillow block 54 at the end of the head assembly. This mounting of the sensor assembly 44 on the pillow block 54 provides perpendicularity between the sensors 48 in the ends of the sensor assembly 44 and the target wheels 36. A single fastener 56 may be used to secure the sensor assembly 44 to the pillow block 54.

The end 60 of each of the assembled camshafts 40 is mounted in a bearing assembly that is held between the pillow block 54 and a cam cap 58 as well known in the art. Positioning each of the target wheels 36 on a respective camshaft 40 spaced from the end of the camshaft 40 and inboard of the pillow block 54 eliminates the need to increase the length of the head that occurs if the target wheel is mounted on the front or rear end of the camshaft. With the target wheel 36 in this position, the sensors 48 may be positioned along a line that is along the axis of the camshaft and is spaced from the ends of the camshaft.

Having thus described a presently preferred implementation of the camshaft and position sensing assembly, various modifications and alterations will occur to those skilled in the art, which modifications and alterations will be within the scope of the invention as defined by the appended claims.

What is claimed is:

1. A camshaft and a sensor assembly for an internal combustion engine comprising:

a first camshaft including a first shaft, a plurality of cams mounted at spaced locations along the length of the first shaft, and a first target wheel mounted on the shaft and spaced from the ends of the shaft, whereby the target wheel does not increase the effective length of the first shaft;

a second camshaft arranged parallel to the first camshaft, the second camshaft including a second shaft, a plurality of cams mounted at spaced locations along the length of the second shaft, and a second target wheel mounted on and spaced from the end of the second camshaft;

a sensor assembly mounted in a position to sense the rotational position of the target wheel of the first camshaft; and a mount for the sensor assembly that positions the sensor assembly between the two camshafts; and two sensors mounted in the sensor assembly that face in opposite directions and positioned to sense the target wheels on either side of the sensor assembly.

2. The camshaft and sensor assembly of claim 1 wherein the two sensors are positioned on the centerline of the camshafts.

3. The camshaft and sensor assembly of claim 2 therein the two sensors as positioned along a line that is along the axis of the camshaft and spaced from the ends of the camshafts.

4. The camshaft and sensor assembly of claim 3 further comprising:

a pillow block for mounting the ends of the camshafts, the pillow block providing a mounting surface for the sensor assembly.

5. The camshaft and sensor assembly of claim 4, wherein the target wheels are located on the same side of the pillow block as the cams, whereby the target wheels do not increase the overall length of the engine.

6. A dual camshaft and sensor assembly for an internal combustion engine comprising:

a pair of camshafts, each camshaft including a shaft having a longitudinal axis, a first end, and a second end, and a plurality of earns and a target wheel mounted at spaced locations along the length of the shaft intermediate the first and second ends of the shaft;

a sensor assembly including a first sensor for sensing a rotation of the target wheel of the first camshaft and a second sensor for sensing a rotation of the target wheel of the second camshaft, wherein the sensor assembly is mounted between the two camshafts; and wherein the first and second sensors face in opposite directions enabling sensing of a corresponding one of the target wheels on either side of the sensor assembly.

7. The camshaft and sensor assembly of claim 6, wherein the two sensors are positioned within a reference plane that includes the longitudinal axis of each camshaft.

8. The camshaft and sensor assembly of claim 7, wherein one end of each camshaft is supported by a pillow block, and wherein the sensor assembly is mounted on the pillow block.

9. The camshaft and sensor assembly of claim 8, wherein the target wheel of each camshaft is located on the same side of the pillow block as the cams.

10. A dual camshaft and sensor assembly for an internal combustion engine comprising:

a pair of camshafts, each camshaft including a shaft having a longitudinal axis, a first end, and a second end, and a plurality of vans and a target wheel mounted at spaced locations along the length of the shall intermediate the first and second ends of the shaft;

a sensor assembly including a first sensor for sensing a rotation of the target wheel of the first camshaft and a second sensor for sensing a rotation of the target wheel of the second camshaft, wherein the sensor assembly is mounted between the two camshafts, and wherein the first and second sensors face outwardly in opposite directions enabling sensing of a corresponding one of the target wheels on either side of the sensor assembly;

a pillow block that supports one end of each camshaft; and wherein the sensor assembly is mounted to the pillow block.

* * * * *